US011587748B2

(12) United States Patent
Cernat et al.

(10) Patent No.: US 11,587,748 B2
(45) Date of Patent: Feb. 21, 2023

(54) HIGH-VOLTAGE POWER SWITCH WITH CLOSING RESISTOR ARRANGEMENT

(71) Applicant: Siemens Energy Global GmbH & Co. KG, Munich (DE)

(72) Inventors: Radu-Marian Cernat, Berlin (DE); Armin Grund, Berlin (DE); Johannes Kern, Berlin (DE); Friedrich Loebner, Berlin (DE); Andrzej Nowakowski, Berlin (DE); Frank Reichert, Weissenfels (DE); Jens Schimmelpfennig, Berlin (DE); Andre Singer, Wandlitz OT Schoenwalde (DE); Wolfgang Soerries, Berlin (DE); Stefan Wilke, Dallgow-Doeberitz (DE)

(73) Assignee: Siemens Energy Global GmbH & Co. KG, Muenchem (DE)

( * ) Notice: Subject to any disclaimer, the term of this patent is extended or adjusted under 35 U.S.C. 154(b) by 0 days.

(21) Appl. No.: 17/048,665

(22) PCT Filed: Jan. 30, 2019

(86) PCT No.: PCT/EP2019/052227
§ 371 (c)(1),
(2) Date: Oct. 19, 2020

(87) PCT Pub. No.: WO2019/201486
PCT Pub. Date: Oct. 24, 2019

(65) Prior Publication Data

US 2021/0183598 A1 Jun. 17, 2021

(30) Foreign Application Priority Data

Apr. 18, 2018 (DE) ..... 1 02018 205 910

(51) Int. Cl.
*H01H 9/42* (2006.01)
*H01H 33/16* (2006.01)
*H01H 33/666* (2006.01)

(52) U.S. Cl.
CPC ..... *H01H 33/166* (2013.01); *H01H 9/42* (2013.01); *H01H 33/666* (2013.01)

(58) Field of Classification Search
CPC .... H01H 33/166; H01H 33/16; H01H 33/168; H01H 33/666; H01H 33/66207;
(Continued)

(56) References Cited

U.S. PATENT DOCUMENTS 2,596,254 A 5/1952 Latour
4,009,458 A 2/1977 Kishi et al.
(Continued)

FOREIGN PATENT DOCUMENTS

CN 101393815 A 3/2009
CN 201387842 Y 1/2010
(Continued)

OTHER PUBLICATIONS

Translation DE0022535 (Original document published Jan. 21, 1981) (Year: 1981).*

*Primary Examiner* — William A Bolton
(74) *Attorney, Agent, or Firm* — Laurence A. Greenberg; Werner H. Stemer; Ralphe E. Locher

(57) ABSTRACT

A high-voltage power switch, preferably with a dead tank design, contains: a switching unit that has a switching device and an actuation element that is axially movable in relation to a longitudinal axis of the switching device to actuate the switching device and a closing resistor unit that has a closing resistor arrangement and an adjusting element that is axially movable in relation to a longitudinal axis of this closing resistor arrangement to actuate the closing resistor arrange-
(Continued)

ment. The actuation element is coupled to the adjusting element in order to move the latter. Accordingly, the longitudinal axis of the switching unit and the longitudinal axis of the closing resistor unit are spaced apart, and the actuation and adjusting elements are coupled by a coupling device of the high-voltage power switch.

8 Claims, 4 Drawing Sheets

(58) Field of Classification Search
CPC ..... H01H 9/42; H01H 33/14; H01H 33/82; H01H 33/28
USPC ..... 218/143, 102; 361/58; 200/144 AP, 200/148 A, 148 F
See application file for complete search history.

(56) References Cited

U.S. PATENT DOCUMENTS 4,069,406 A 1/1978 Meinders
4,365,128 A * 12/1982 Mascher ..... H01H 3/42 218/84
4,499,350 A * 2/1985 Hidaka ..... H01H 33/16 218/143
5,245,145 A 9/1993 Freeman et al.
5,304,760 A * 4/1994 Pham ..... H01H 33/16 218/143
5,391,930 A * 2/1995 Ohshita ..... H01H 33/168 307/98
5,484,972 A 1/1996 Tecchio
5,604,340 A * 2/1997 Yamada ..... H01H 33/16 218/143
8,426,760 B2 * 4/2013 Holaus ..... H01H 33/16 218/143
9,431,194 B2 * 8/2016 Lim ..... H01H 33/166
2009/0067108 A1 3/2009 Kruesi et al.
2010/0219163 A1 9/2010 Holaus et al.
2014/0061162 A1 3/2014 Cuppett et al.
2014/0076853 A1 3/2014 Cuppett et al.

FOREIGN PATENT DOCUMENTS

CN 101855694 A 10/2010
CN 203250698 U 10/2013
DE 1953997 A1 4/1997
DE 19539997 A1 4/1997
EP 0022535 A1 1/1981
EP 0024252 A1 2/1981
EP 2034500 A1 3/2009

* cited by examiner

HIGH-VOLTAGE POWER SWITCH WITH CLOSING RESISTOR ARRANGEMENT

BACKGROUND OF THE INVENTION

Field of the Invention

The invention relates to a high-voltage circuit breaker, preferably of dead tank design, comprising a switching unit which has a switching device and an operating element, which is axially movable in relation to a longitudinal axis of the switching device, for operating the switching device and comprising a closing resistor unit which has a closing resistor arrangement and an actuating element, which is axially movable in relation to a longitudinal axis of this closing resistor arrangement, for operating the closing resistor arrangement, wherein the operating element is coupled to the actuating element in order to move said actuating element.

For functional reasons, the closing resistor of the closing resistor arrangement is connected shortly before the electrical circuit is closed by the switching device of the high-voltage circuit breaker and shorted after a short time (also called action time). Here, two designs are possible in principle, wherein the closing resistor can be connected in parallel or in series with the switching unit. In the case of the parallel connection, the closing resistor is connected by an additional contact system before the switching unit and then shorted by the switching unit. This contact system has to be of high-voltage-resistant design, but not dimensioned for a high current-carrying capacity. In the case of the series connection, the switching device first closes, and therefore connects the closing resistor. Said closing resistor is subsequently shorted by an additional contact system which is designed for a high current-carrying capacity, but does not have to meet a stringent dielectric requirement. In the case of metal-encapsulated high-voltage circuit breakers, a solution has been established for both variants which combines the circuit breakers and the closing resistor in a gas container. Here, the available installation space is not utilized in an optimum manner on account of deviations in the axial symmetry. One disadvantage in this case is the unnecessarily large gas volume which is filled with environmentally harmful SF6 gas in most cases.

A high-voltage circuit breaker of this kind with a closing resistor arrangement is known from document U.S. Pat. No. 5,245,145 A. Said document describes a high-voltage circuit breaker of dead tank design, comprising a switching unit which has a switching device, referred to as an interrupter unit, and an operating element, which is axially movable in relation to a longitudinal axis of the switching device, for operating the switching device and comprising a closing resistor unit which has a closing resistor arrangement (EWID arrangement) and an actuating element, which is axially movable in relation to a longitudinal axis of this closing resistor arrangement, for operating the closing resistor arrangement. The two longitudinal axes are arranged substantially coaxially, so that the operating element and the actuating element are coupled via the common axis. The coupling can take place directly or by means of a kind of coupling device which then, however, consists only of one intermediate element which is located in an enclosed gas area of the high-voltage circuit breaker. The two said units are jointly located in a high-voltage circuit breaker housing in this case.

SUMMARY OF THE INVENTION

The object of the invention is to specify a high-voltage circuit breaker which has a different construction and is of more compact design in particular.

The object is achieved by the features of the independent claims. Advantageous refinements are specified in the dependent claims.

In the high-voltage circuit breaker according to the invention comprising (i) a switching unit which has a switching device and an operating element, which is axially movable in relation to a longitudinal axis of the switching device, for operating the switching device and comprising (ii) a closing resistor unit which has a closing resistor arrangement and an actuating element, which is axially movable in relation to a longitudinal axis of this closing resistor arrangement, for operating the closing resistor arrangement, wherein the operating element is coupled to the actuating element in order to move said actuating element, provision is made for the longitudinal axis of the switching unit and the longitudinal axis of the closing resistor unit to be spaced apart from one another, wherein the operating element and the actuating element are coupled by means of a coupling device of the high-voltage circuit breaker. Therefore, the switching unit and the closing resistor unit are not arranged coaxially one behind the other on a common axis by way of their longitudinal axes and can now be arranged next to one another in a compact manner. However, a coupling device is required for coupling the operating element and the actuating element.

Given a compact arrangement of this kind next to one another, the two units (switching unit and closing resistor unit) are arranged next to one another in relation to at least one of the two corresponding longitudinal axes or, in other words, there is an axial overlap of the two units in relation to at least one of the two longitudinal axes.

The high-voltage circuit breaker or at least its switching unit is preferably of dead tank design. In the second case, the switching unit is therefore a dead tank switch.

According to a preferred refinement of the invention, provision is made for the longitudinal axes of the switching device and of the closing resistor arrangement (EWID arrangement) to have an axis offset. In this case, the two longitudinal axes are arranged in parallel in particular. The coupling device is then used for compensating for the axis offset between the longitudinal axes of the switching unit and of the closing resistor arrangement and runs substantially transversely, for example perpendicularly, to these axes. In general, the longitudinal axis of the switching device is also the longitudinal axis of the entire switching unit and the longitudinal axis of the closing resistor unit is also the longitudinal axis of the entire closing resistor unit.

The high-voltage circuit breaker advantageously has a frame or some other base which carries the switching unit and the closing resistor unit. Terms such as "above", "below" or "next to" are clearly defined with respect to this base.

According to a preferred refinement of the invention, provision is made for the switching unit and the closing resistor unit to be arranged next to one another. In this case, provision is made in particular for the two units to have substantially the same height in relation to the frame/the base.

According to a further preferred refinement of the invention, provision is made as an alternative or in addition for the switching unit to be arranged above the closing resistor unit. As a result, a large amount of surface area is not required.

As an alternative to this, provision is advantageously made for the closing resistor unit to be arranged above the switching unit. As a result, a large amount of surface area is not required either.

According to yet another preferred embodiment of the invention, the switching unit and the closing resistor unit each have their own housing. In this case, the housings are configured such that one housing (switch housing) can be clearly associated with the switching unit and the other housing (closing resistor housing) can be clearly associated with the closing resistor unit.

In this case, provision is made in particular for the interiors of the housings to be connected to one another by means of at least one cross connection, that is to say a housing cross connection. A common gas area is produced in this way.

According to a preferred refinement of the invention, provision is made for the coupling device to have a coupling mechanism. The corresponding coupling is therefore a mechanical coupling.

Exemplary embodiments of the invention will be shown in drawings below and described in more detail in the text which follows.

BRIEF DESCRIPTION OF THE SEVERAL VIEWS OF THE DRAWING

Exemplary embodiments of the invention will be shown in drawings below and described in more detail in the text which follows. In the drawings.

DETAILED DESCRIPTION OF THE INVENTION

Figure 1:
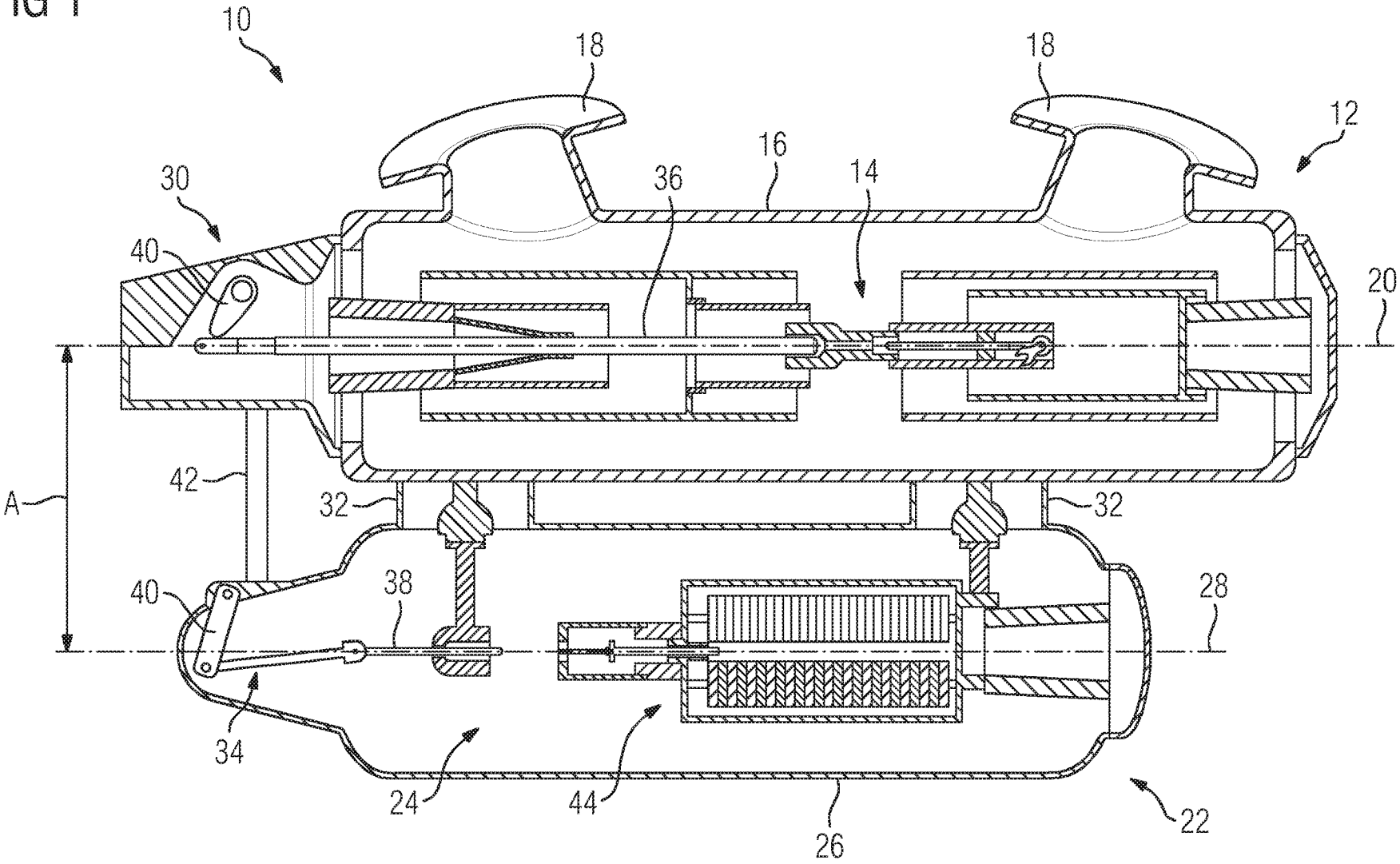
FIG. 1 shows a high-voltage circuit breaker according to a first preferred embodiment of the invention.

FIG. 1 shows a high-voltage circuit breaker 10 of dead tank design. This high-voltage circuit breaker 10 comprises a switching unit 12 having a switching device 14 and a switching housing 16 which encloses the switching device 14 and has two connection flanges 18. The switching unit 12 of a high-voltage circuit breaker 10 is generally also referred to as an interrupter unit (UE). The corresponding switching device 14 has a longitudinal axis 20. The switch housing 16 is configured such that it takes on this longitudinal axis 20, so that the longitudinal axis 20 is also the longitudinal axis of the entire switching unit 12. In addition to the switching unit 12, the high-voltage circuit breaker 10 furthermore also has a closing resistor unit (EWID unit) 22 comprising a closing resistor arrangement (EWID arrangement) 24 and a closing resistor housing 26 which encloses the closing resistor arrangement 24. The closing resistor arrangement 24 also has a longitudinal axis 28. The closing resistor housing 26 is configured such that it takes on this longitudinal axis 28, so that the longitudinal axis 28 of the closing resistor arrangement 24 is also the longitudinal axis of the entire closing resistor unit 22.

The longitudinal axis 20 of the switching unit 12 and the longitudinal axis 28 of the closing resistor unit 22 are oriented in parallel and in so doing are spaced apart from one another. In other words, the longitudinal axes 20, 28 of the switching device 14 and of the closing resistor arrangement 24 have an axis offset A.

Furthermore, the high-voltage circuit breaker 10 has a coupling device 30 which couples the operation of the closing resistor arrangement 24 to operation of the switching device 14. To this end, the coupling device 30 leads from the switching unit 12 to the closing resistor unit 22 and is configured as a coupling mechanism 34. For the purpose of compensating for the axis offset A between the longitudinal axes 20, 28 of the switching unit 12 and of the closing resistor arrangement 22, the coupling device 30 runs substantially perpendicularly to these axes 20, 28. The interiors of the two housings 16, 26 are connected to one another via cross connections 32, that is to say housing cross connections. A common gas area is produced in this way. The cross connections 32 allow corresponding electrical contact connections between components of the two units 12, 22.

Unlike in the prior art mentioned at the outset, the switching device 14 and the closing resistor arrangement 24 are not arranged coaxially one behind the other on a common axis by way of their longitudinal axes 20, 28, but rather next to one another in a compact manner. Given a compact arrangement of this kind next to one another, the two units (switching unit and closing resistor unit) 12, 22 are therefore arranged next to one another in relation to their longitudinal axes 20, 28.

An operating element 36 for operating the switching device 14 is provided in the housing 16 of the switching unit 12, which operating element is axially movable in relation to the longitudinal axis 20 of the switching device 14. An actuating element 38 for operating the closing resistor arrangement 24 is provided in the housing 26 of the closing resistor unit 22, which actuating element is substantially axially movable in relation to the longitudinal axis 28 of the closing resistor arrangement 24. The coupling mechanism 34 has levers 40 and a linkage 42 between the levers 40. Said coupling mechanism therefore has a certain degree of similarity to a conventional wiper linkage of a windscreen wiper in an automobile.

In the variant shown in FIG. 1 of the high-voltage circuit breaker 10, the two units 12, 22 are arranged one above the other, wherein specifically the switching unit 12 is arranged above the closing resistor unit 22 here.

FIGS. 2 to 6 show further variants of the high-voltage circuit breaker 10 which correspond to the variant of FIG. 1 in many aspects, and therefore only the differences from the variant of FIG. 1 are discussed below.

Figure 2:
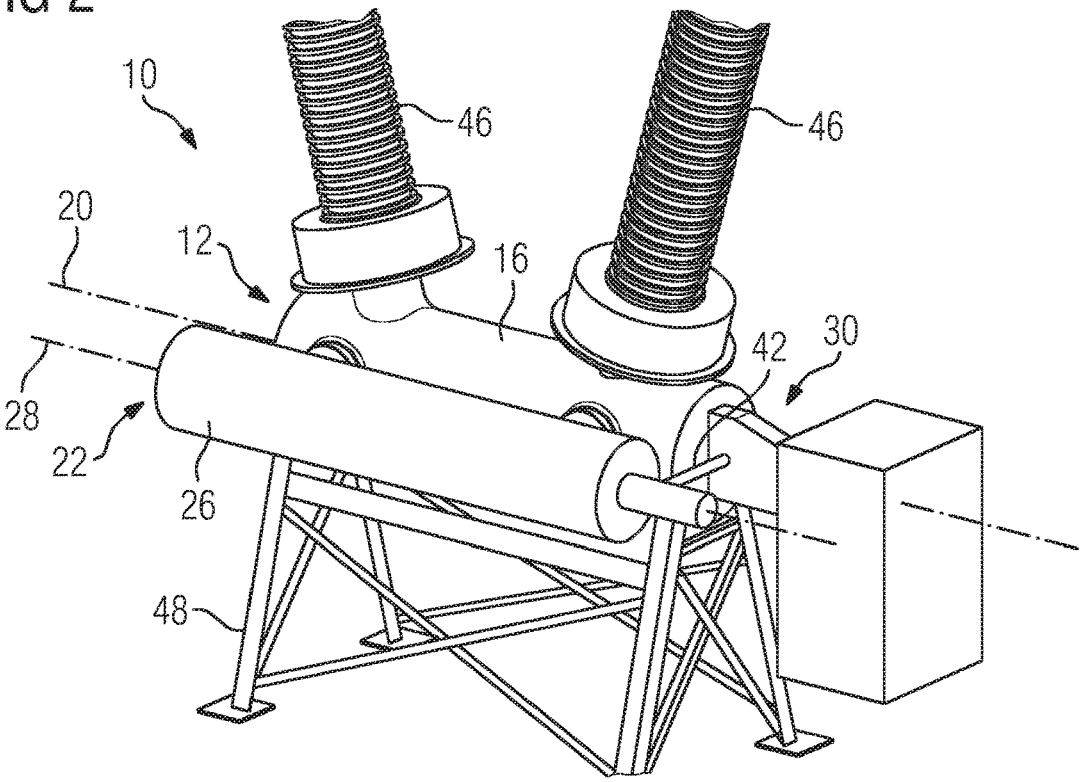
FIG. 2 shows a high-voltage circuit breaker according to a second preferred embodiment of the invention.

FIG. 2 shows a variant of the high-voltage circuit breaker 10 in which the two units 12, 22 are arranged laterally next to one another. A corresponding actuator for the operating element 36 and, indirectly via the coupling device 30, also for the actuating element 38 can also be seen at one end of the switching unit 12 at which the coupling device 30 can also be found.

Figure 3:
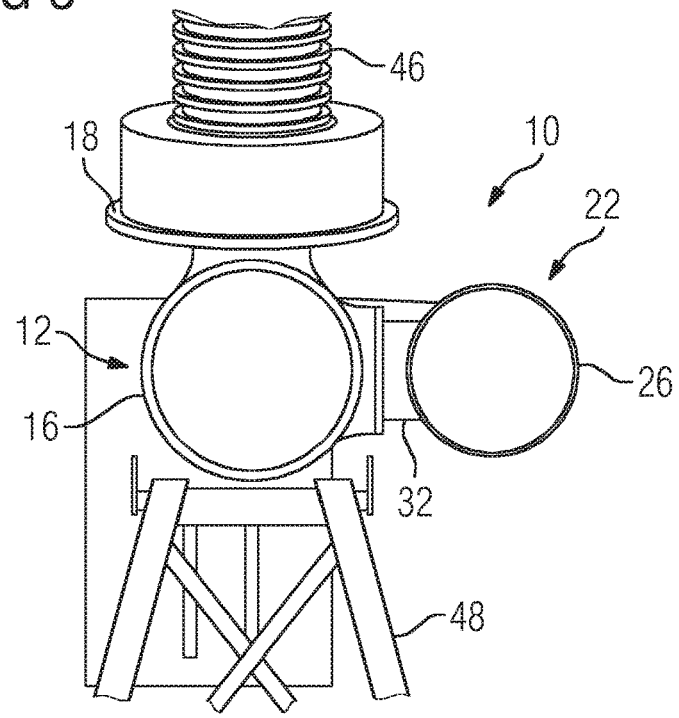
FIG. 3 shows the high-voltage circuit breaker shown in FIG. 2 from a different perspective.

Here, in FIGS. 2 and 3, the bushings 46 which are wholly typical of high-voltage circuit breakers 10 of this kind can now also be seen on the switch housing 16 of the switching unit 12. Said bushings are flange-connected to the connection flanges 18 known from FIG. 1 of the switch housing 16.

The high-voltage circuit breaker 10 furthermore has a frame 48 which carries the switching unit 12 and the closing resistor unit 22 (or alternatively some other base for the two units 12, 22). The terms "above", "below" or "next to" for describing the arrangement of the units 12, 22 are then clearly defined with respect to this frame 48.

In the example of FIGS. 2 and 3, the switching unit 12 and the closing resistor unit 22—as already mentioned—are arranged horizontally next to one another, wherein the two units 12, 22 have substantially the same height in relation to the frame 48.

Figure 4:
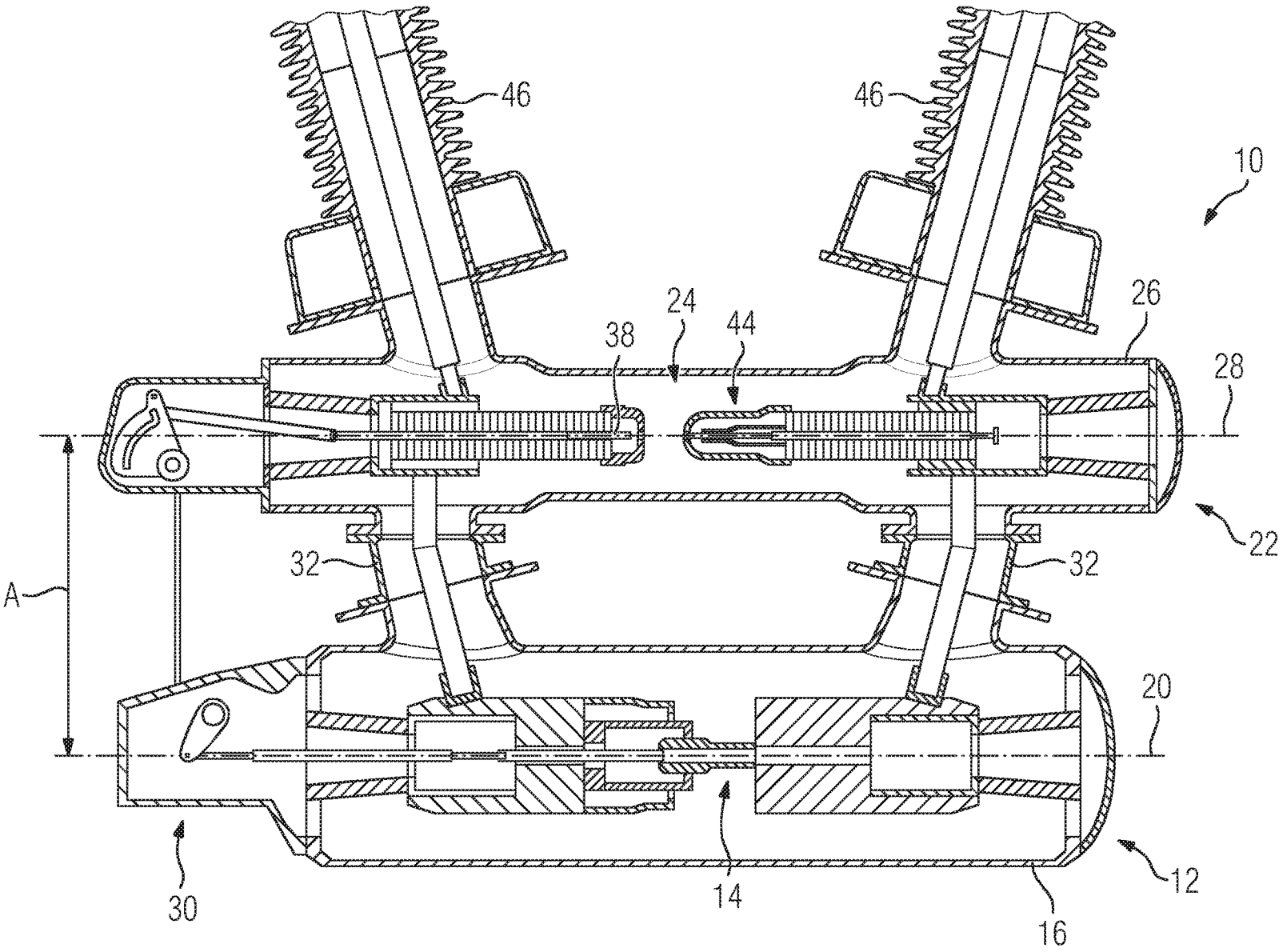
FIG. 4 shows a high-voltage circuit breaker according to a third preferred embodiment of the invention.

FIG. 4 shows a variant of the high-voltage circuit breaker 10 in which the closing resistor unit 22 is arranged above the switching unit 12. Here, the bushings 46 are flange-connected to the closing resistor housing 26. Contact is made with the switching device 14 by way of the closing resistor housing 26 and the housing cross connections 32.

Figure 5:
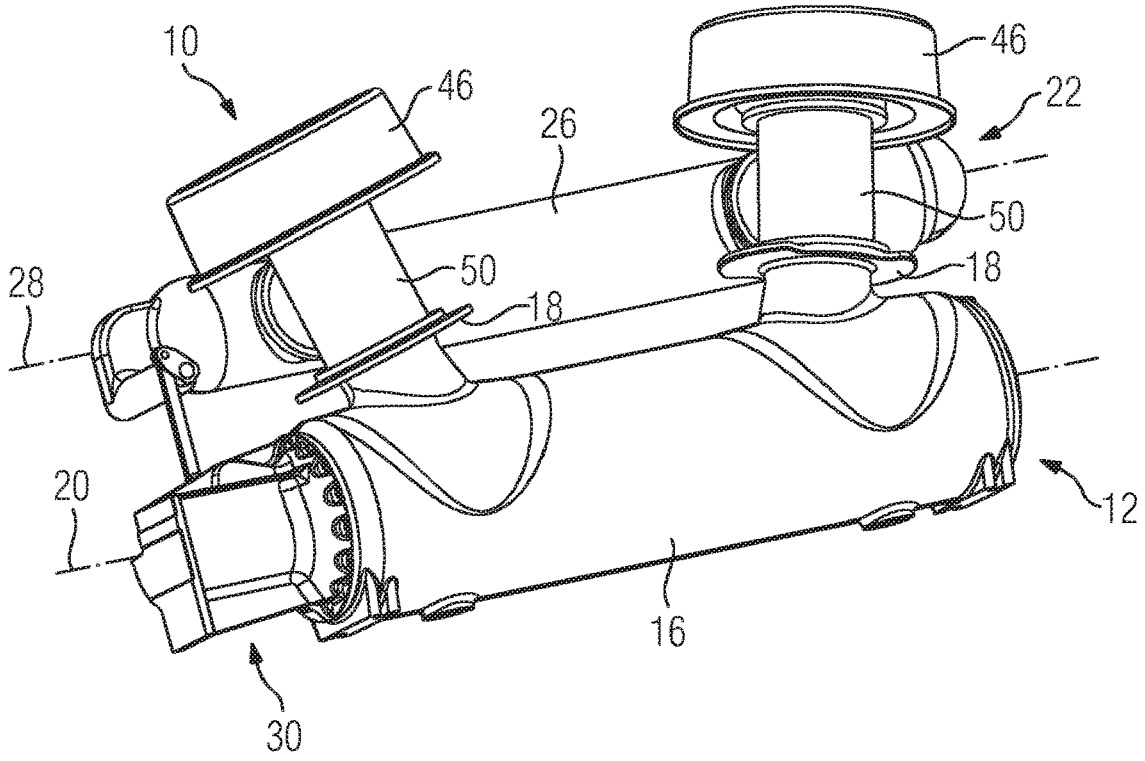
FIG. 5 shows a high-voltage circuit breaker according to a fourth preferred embodiment of the invention.
Figure 6:
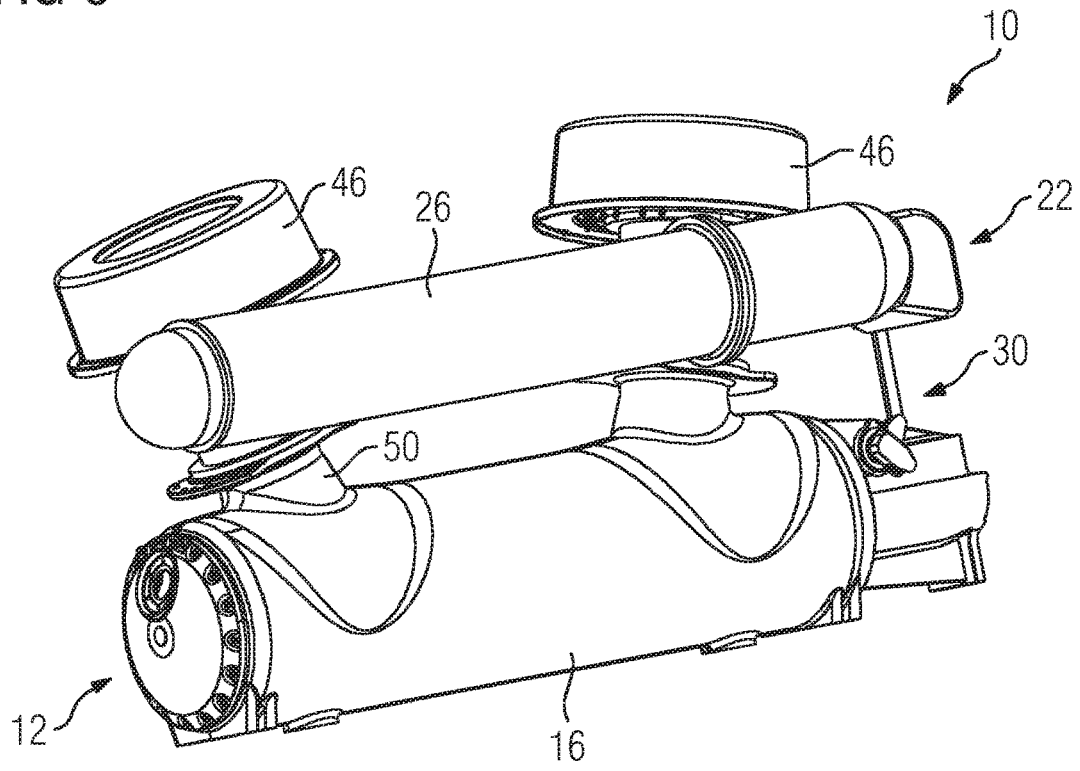
FIG. 6 shows the high-voltage circuit breaker shown in FIG. 5 from a different perspective.

The switching unit 12 and the closing resistor unit 22 are arranged next to one another in the example of FIGS. 5 and 6 too, wherein the closing resistor unit 22 is arranged higher than the switching unit 12. FIG. 5 shows the high-voltage circuit breaker 10 from one side, and FIG. 6 shows said high-voltage circuit breaker from the other side.

In this example, the two units 12, 22 are connected to one another by means of intermediate elements 50 and are each connected to a bushing 46. The intermediate elements 50 are a kind of T-shaped cross connection 32 which each allow the additional connection of a bushing 46.

Some aspects of the invention will be explained once again below with reference to the examples shown in other words:

A very compact circuit breaker 10 is formed owing to the non-coaxial arrangement of the switching unit 12 and the closing resistor unit 22. The highest "packing density" is achieved by the parallel arrangement of the switching unit 12 and the closing resistor unit 22 in a dedicated tank. The two units 12, 22 can be positioned differently in relation to one another, wherein each individual installation position has positive and somewhat problematical aspects.

Example of FIG. 1—EWID housing 26 below the switch housing 16:

Positive Aspects:

EWID housing 26 can be integrated in the frame 48 of the switch 10;

compact construction; space-saving;

cost-effective mechanical coupling since drive shafts of the switching unit 12 and of the EWID unit 22 are arranged parallel to one another and the outer drive levers lie in one plane.

Problematical Aspects:

particles and combustion products from the circuit breaker housing can fall into the EWID housing 26;

transportation height for the gas area increases (the switch pole is usually delivered with installed bushings prefilled with SF6 and without a frame 48, so that the gas area remains closed at the installation site and cannot be contaminated by soiling).

Example of FIGS. 2 and 3—EWID housing 26 next to the switch housing 16, at the same height:

Positive Aspects:

transportation height does not change and the circuit breaker 10 can be delivered with an installed EWID unit 22 as before;

particles and combustion products cannot fall out of the switch housing 16 into the EWID housing 26.

Problematical Aspects:

complex mechanical coupling of the two drive shafts (EWID and circuit breaker); for example cardan shaft or additional deflection with lever linkage 42.

Example of FIG. 4—EWID housing 26 above the switch housing 16:

Positive Aspects:

identical switch housings 16 can be used for variants with an EWID unit 22 and without an EWID unit 22;

particles and combustion products cannot fall out of the switch housing 16 into the EWID housing 26.

Problematical Aspect:

total height of the switch 10 with an EWID unit 22 increases (transportation problems; integration in the span).

Example of FIGS. 5 and 6—EWID housing with intermediate modules 50 laterally offset above the switch housing 16:

Positive Aspects:

identical switch housings 16 can be used for variants with an EWID unit 22 and without an EWID unit 22;

particles and combustion products cannot fall out of the switch housing 16 into the EWID housing 26;

total height is only minimally influenced.

Problematical Aspects:

center of gravity of the high-voltage circuit breaker 10 shifts in an unfavorable manner overall, strengthening of the mechanical structure required.

REFERENCE SIGNS

10 High-voltage circuit breaker
12 Switching unit
14 Switching device
16 Switch housing
18 Connection flange
20 Longitudinal axis (switching unit)
22 Closing resistor unit
24 Closing resistor arrangement
26 Closing resistor housing
28 Longitudinal axis (closing resistor unit)
30 Coupling device
32 Cross connection
34 Coupling mechanism
36 Operating element (movable)
38 Actuating element (movable)
40 Lever
42 Linkage
44 Resistor disk stack
46 Bushing
48 Frame
50 Intermediate element
A Axis offset

The invention claimed is:

1. A high-voltage circuit breaker, comprising:

a switching unit having a switching device and an operating element being axially movable in relation to a longitudinal axis of said switching device, for operating said switching device, said switching unit having a housing with an interior;

a coupling device having a coupling mechanism with at least one linkage;

a closing resistor unit having a closing resistor configuration and an actuating element, being axially movable in relation to a longitudinal axis of said closing resistor configuration, for operating said closing resistor configuration, wherein said operating element is coupled to said actuating element by said at least one linkage to move said actuating element, wherein the longitudinal axis of said switching unit and the longitudinal axis of said closing resistor unit are spaced apart from one another, wherein said closing resistor unit further having a housing with an interior, said at least one linkage of said coupling device being disposed outside of all housings including outside said housing of said switching unit and outside said housing of said closing resistor unit and therefore being exposed to a surrounding environment;

at least one cross connection, said interior of said housing of said switching unit connected to said interior of said housing of said closing resistor unit by means of said at least one cross connection; and the high-voltage circuit breaker having a dead tank design.

2. The high-voltage circuit breaker according to claim 1, wherein the longitudinal axes of said switching device and of said closing resistor configuration have an axis offset.

3. The high-voltage circuit breaker according to claim 2, wherein the longitudinal axes of said switching device and of said closing resistor configuration are disposed in parallel.

4. The high-voltage circuit breaker according to claim 1, further comprising a frame or some other base which carries said switching unit and said closing resistor unit.

5. The high-voltage circuit breaker according to claim 1, wherein said switching unit and said closing resistor unit are disposed next to one another.

6. The high-voltage circuit breaker according to claim 1, wherein said switching unit is disposed above said closing resistor unit.

7. The high-voltage circuit breaker according to claim 1, wherein said closing resistor unit is disposed above said switching unit.

8. The high-voltage circuit breaker according to claim 1, wherein said coupling mechanism further has at least one lever and/or at least one shaft.

* * * * *